US011892160B1

(12) United States Patent
Ferris et al.

(10) Patent No.: US 11,892,160 B1
(45) Date of Patent: Feb. 6, 2024

(54) SYSTEM TO ACHIEVE FULL COMBUSTION TURBINE LOAD IN HRSG LIMITED COMBINED CYCLE PLANTS

(71) Applicant: HRST, Inc., Eden Prairie, MN (US)

(72) Inventors: Victor Ferris, Minneapolis, MN (US); Anand Gopa Kumar, Savage, MN (US); Evan Almberg, Woodland Park, CO (US); Bryan Craig, Oldsmar, FL (US)

(73) Assignee: HRST, Inc., Eden Prairie, MN (US)

( * ) Notice: Subject to any disclaimer, the term of this patent is extended or adjusted under 35 U.S.C. 154(b) by 47 days.

(21) Appl. No.: 17/901,311

(22) Filed: Sep. 1, 2022

(51) Int. Cl.

| | |
|---|---|
| ***F22B 1/18*** | (2006.01) |
| ***F22D 5/30*** | (2006.01) |
| ***F22B 35/10*** | (2006.01) |
| ***F22D 5/34*** | (2006.01) |
| ***F22D 1/28*** | (2006.01) |

(52) U.S. Cl.
CPC ..... *F22D 5/30* (2013.01); *F22B 35/10* (2013.01); *F22D 1/28* (2013.01); *F22D 5/34* (2013.01)

(58) Field of Classification Search
CPC ..... F22D 5/30; F22D 1/28; F22D 5/34; F22D 5/00; F22B 35/10; F22B 1/1815; F22B 1/18; F22B 1/1807; F22G 7/00
See application file for complete search history.

(56) References Cited

U.S. PATENT DOCUMENTS

| | | | | |
|---|---|---|---|---|
| 4,207,842 | A * | 6/1980 | Kehlhofer | F01K 23/108 60/39.182 |
| 7,243,618 | B2 * | 7/2007 | Gurevich | F22B 35/02 122/406.1 |
| 8,002,902 | B2 | 8/2011 | Krowech | |
| 9,091,349 | B2 | 7/2015 | Krowech | |
| 9,097,418 | B2 * | 8/2015 | Rancruel | F22D 5/00 |
| 9,435,228 | B2 | 9/2016 | Sieben | |
| 10,281,172 | B2 | 5/2019 | Krowech | |
| 10,605,450 | B2 | 3/2020 | Krowech | |
| 11,073,348 | B2 | 7/2021 | Sogard | |
| 2012/0198846 | A1 | 8/2012 | Sieben | |
| 2013/0220238 | A1 | 8/2013 | Krowech | |
| 2016/0376986 | A1 | 12/2016 | Ferris | |

FOREIGN PATENT DOCUMENTS

| | | | | |
|---|---|---|---|---|
| GB | 2099558 | A * | 12/1982 | F22B 1/1815 |

* cited by examiner

*Primary Examiner* — Gregory A Wilson
(74) *Attorney, Agent, or Firm* — Edwin E. Voigt, II

(57) ABSTRACT

A method of suppressing steam production in a HRSG where a volume of feed water is diverted upstream bypassing a portion of the economizer and returning the volume of diverted feed water to a downstream portion of the economizer. A control logic circuit is used to manipulate a suppression control valve regulating the bypassed feed water, thereby reducing the temperature of water in the steam drum. Bypassing feed water flow into a downstream portion of an economizer reduces the steam production rate in the steam drum by increasing the evaporator approach temperature, permitting gas turbines to operate at base load even after an upgrade, by preventing the waste heat boiler from exceeding its rated capacity and pressure.

9 Claims, 2 Drawing Sheets

SYSTEM TO ACHIEVE FULL COMBUSTION TURBINE LOAD IN HRSG LIMITED COMBINED CYCLE PLANTS

FIELD OF THE INVENTION

The present invention generally relates to controlling steam generation and pressure within heat recovery steam generators (herein after HRSGs).

BACKGROUND

In one example, Heat Recovery Steam Generators (HRSGs) are used within a process which generates a significant amount of waste heat at high temperatures, which in turn is suitable for steam power generation. A common form of an HRSG may be found in a combined cycle power plant, including a gas turbine, which is used to generate power. The exhaust gases exiting the turbine are fed into a steam generator where the heat is used to generate steam to create additional electric power.

In order to provide flexibility in power generation and increased power, many HRSGs are equipped with additional duct burner elements. The additional duct burner elements provide for increased power output, more rapid startup cycles to satisfy the demands of a variable power grid, and more flexibility in operation.

The inclusion of additional duct burner elements increases the complexity and requirements upon a HRSG to ensure the safety of the operators and bystanders, especially with plants having aging burners, or plants which are operating beyond their initially intended capacity.

Combined cycle power plant boilers and other heat recovery steam generators are located behind combustion turbines. Most of the combined cycle power plant boilers in the United States were designed for base load operation with minimal design tolerance limits. With changing energy markets, many combustion turbines that drive combined cycle power plant boilers are undergoing upgrades to increase power output, and to reduce the turbine's heat rate. These upgrades generally increase the turbine exhaust gas energy entering the HRSG.

Most heat recovery steam generators without duct burners have minimal design tolerances. When HRSGs without duct burners were designed, the rated steaming capacity and maximum allowable working pressure (MAWP) are often determined based on the combustion turbine's operating envelope. After an upgrade, the increased gas side thermal energy from the combustion turbine results in higher steam flow rates and increased steam pressure. In the worst-case scenario, the steam pressure reaches, or exceeds, the MAWP, resulting in pressure safety valves (PSVs) lifting to avoid over-pressurization. Heat recovery steam generators that undergo such issues often operate with a lower combustion turbine load as they cannot reach the intended base load without exceeding the design parameters in the HRSG.

Marginal increases in the combustion turbine exhaust gas temperature and flow rate often have an adverse effect on the heat recovery steam generators such as HRSGs used in the combined cycle system. The higher-than-designed heat input from the combustion turbine causes the pressure and non-pressure part components to be closer to their design temperature and pressure limits. Typical heat recovery steam generators in service were designed for base-loaded operation with enough tolerance to withstand the operating profile of the combustion turbine with some margin.

Heat recovery steam generators without duct burners do not experience high gas and steam temperatures and pressures, and are often designed close to the code allowable design tolerances, and have less margin than those with duct burners. Thermal energy entering the boiler corresponds to the steam production rate and operating pressure. Thereby, combustion turbine upgrades often result in increased steam production rates and steam pressures exceeding design specifications.

Unable to control the steam flow rates, plants in these situations operate their combustion turbine at lower loads after the upgrades. Operating at a lower load prevents the combustion turbine from reaching its peak performance and negates the purpose of the upgrade. Plants assessing the impact before the upgrade often discover this limitation and decide not to pursue a combustion turbine upgrade or will plan to rerate their heat recovery steam generators.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entireties.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

The invention is a system to redirect a portion of feed water flow to bypass a portion of the economizer series heat transfer surface suppressing steam production relative to its original design envelope. The steam generation and pressure reduction may be controlled by modulating the amount of economizer flow that is bypassed.

Upgrades in the combustion turbines improve the efficiency of the turbine and increase the power output from the turbines. The improvement in efficiency in the combustion turbines often results in the turbine operating with a higher exhaust gas temperature or exhaust gas mass flow. Natural gas-powered combined cycle units are fast becoming the primary fossil fuel-based power generation source in the United States and worldwide.

The bypass steam suppressor system reduces the steam production of an evaporator, and its pressure, by increasing the approach temperature at the evaporator. If a combustion turbine after an upgrade causes the waste heat boiler to exceed its rated capacity or its operating pressure, to increase towards the maximum allowable working pressure (MAWP), controlling the steam production rate helps alleviate the capacity concern, while allowing the combustion turbine to operate at base load, rather than operate at a reduced load.

In heat recovery steam generators with supplemental duct firing, these parameters can be controlled in most circumstances by reducing the supplemental firing rate of the duct burner, thereby reducing the steam generation rate and operating pressure. After a combustion turbine upgrade, heat recovery steam generators without supplemental firing capability often generate higher steam flow and experience higher operating pressures than design. In worst-case scenarios, they can exceed their Maximum Allowable Working Pressure (MAWP).

In at least one alternative embodiment, the method of suppressing steam production in a heat recovery steam generator includes diverting a flow of feed water upstream from an economizer series and controlling the volume of the diverted flow of feed water, and bypassing a portion of the economizer series from receiving the controlled volume of diverted flow of feed water. The diverted feed water is then returned to a downstream portion of the economizer series. The diverted feed water entering the downstream portion of the economizer series reduces the temperature for water exiting the economizer series. The water exiting the economizer series is then transferred to the evaporator having a high pressure steam drum. The water exiting the economizer series mixes with heated water in the steam drum lowering the temperature of the mixed water in the high pressure steam drum. The mixed water having a lower temperature is then introduced into the evaporator to generate steam. The rate of production of steam from the evaporator is reduced, and the steam pressure is reduced, because of the decrease in temperature of the mixed water in the high pressure steam drum. The steam is then transferred to a superheater and a steam flow meter reports the steam flow rate of the steam at the steam outlet to a control logic circuit which is used to regulate the bypassed flow of feed water to the economizes and the water level in the high pressure steam drum.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described an embodiment of the invention.

DETAILED DESCRIPTION OF THE PREFERRED EMBODIMENTS

Figure 1:
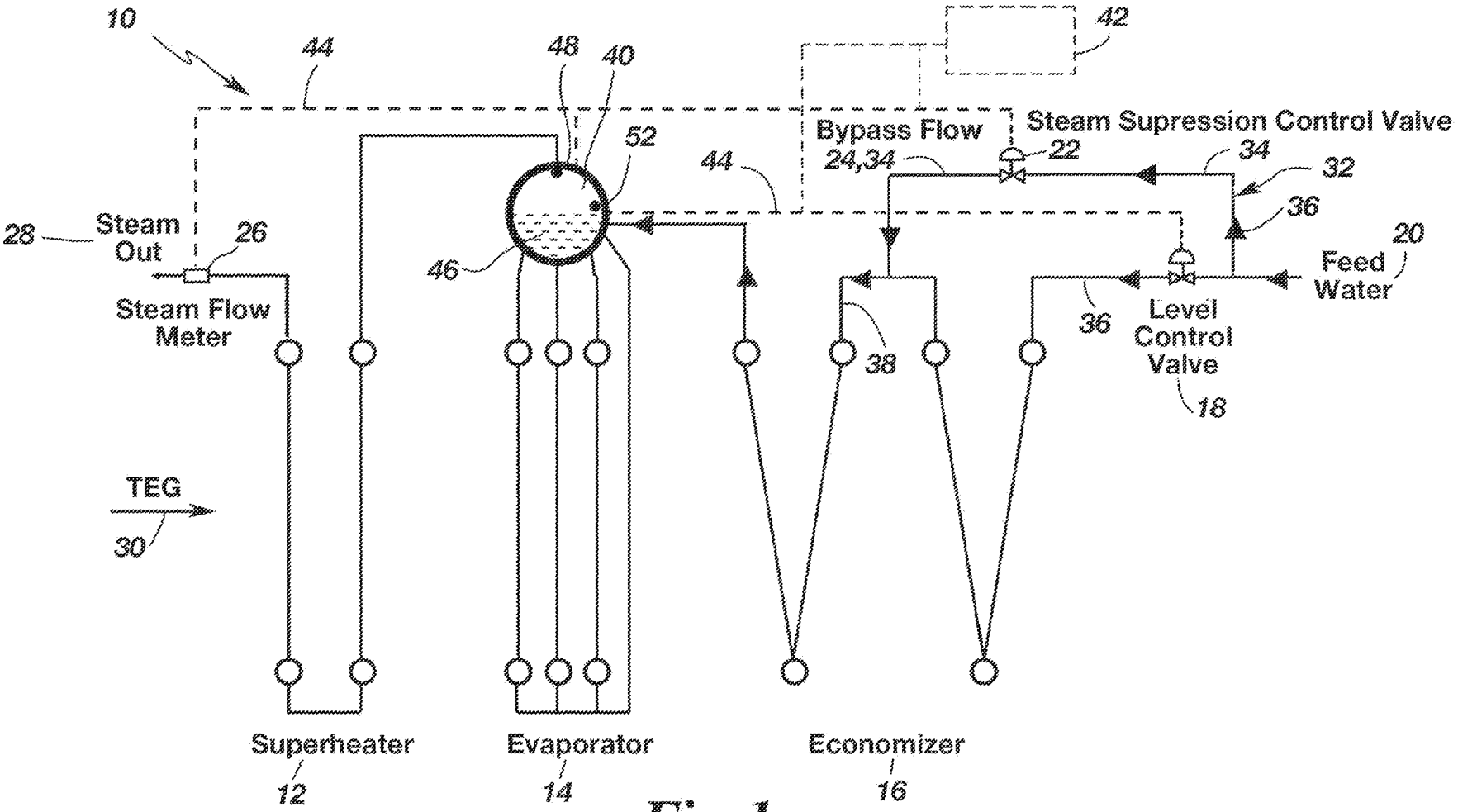
FIG. 1 is a schematic drawing of the system to achieve full combustion turbine in HRSG limited combined plants, showing the bypass steam suppression system, the economizer bypass, the control feed from the steam outlet flow meter, the pressure monitoring in the HP Drum, the bypass piping, and the control tie-in positioned between the final steam flow meter and bypass control valve.

In general the system to achieve full combustion turbine load in HRSG limited combined plants is identified by reference numeral 10. The system to achieve full combustion turbine load in HRSG limited combined plants 10 may also be referenced herein as the bypass steam suppressor system 10.

In general, FIG. 1 shows a schematic of the bypass steam suppression system 10, the economizer bypass 32 and the steam suppression control valve 22 which is in communication with the steam outlet flow meter 26 and a pressure monitoring sensor 48 located in the high pressure steam drum 40. Bypass piping 34 is in communication with and extends from feed water inlet 20 through the steam suppression control valve 22 to a portion of the economizer series 16 or to the evaporator 14.

Figure 2:
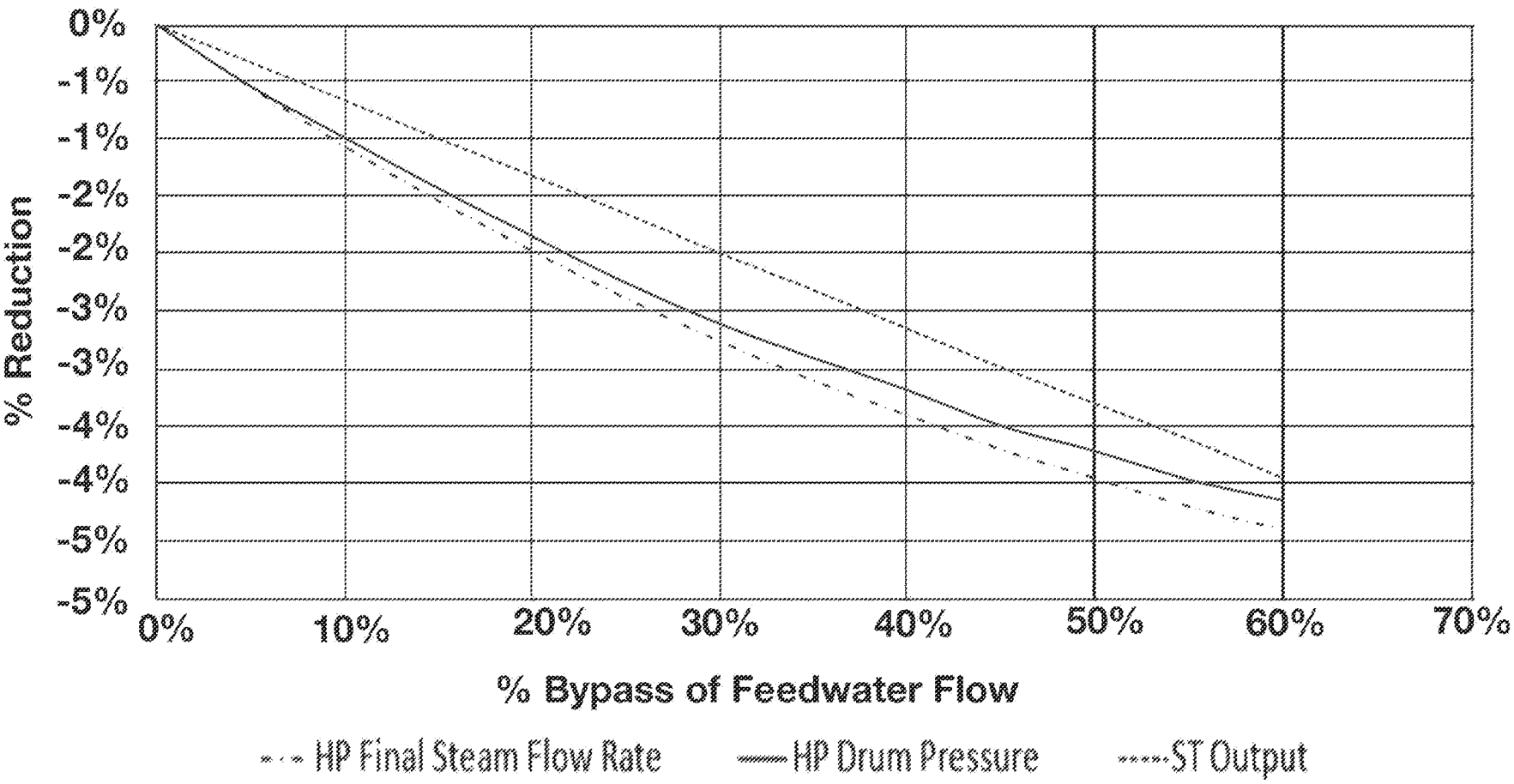
FIG. 2 is a graph showing the reduction in final steam production rate and high pressure drum operating pressure of a triple pressure HRSG (with Reheat) operating behind a combustion turbine.

In general FIG. 2 shows the final steam production rate, the steam reduction rate, the high pressure steam drum 40 operating pressure, and/or the MAWP for a triple pressure HRSG (with Reheat) operating behind a GE Frame 7F™ combustion turbine or equivalent.

In at least one embodiment as shown in FIG. 1 a turbine upgrade has been made in a HRSG limited combined plant. During operation the turbine exhaust gas (TEG) 30 is flowing across the superheater 12, evaporator 14 and economizer 16. As a result of the turbine upgrade, the amount of heat in the TEG 30 is increased, thereby resulting in more steam production in the HRSG. The increased steam production may cause the HRSG to operate at levels of steam production approaching or surpassing the maximum rated levels for steam production for the original design envelope for the HRSG and combustion turbine.

In at least one embodiment, a portion of the feed water flow 36 is redirected to bypass a portion of the economizer heat transfer surface of the economizer series 16 to suppress steam production to the original design envelope for the HRSG and combustion turbine.

Normally a boiler uses cold water, at approximately 140°, to be supplied to the economizer series 16. The economizer series 16 heats the cold feed water to near saturation temperature. The water heated in the economizer series 16 then passes into the evaporator 14 which adds additional heat converting the heated water and causing a phase change of the water into gas/steam. The steam then is passed to the superheater 12 and the superheater 12 increases the steam temperature.

The steam suppression control valve 22 may add cold water, or cooler water, into a portion of the economizer series 16, or alternatively, directly into the high pressure steam drum 40 of the evaporator 14, bypassing at least a portion of the economizer series 16. The addition of cool water inside the high pressure steam drum 40 of the evaporator 14, in turn suppresses steam production from the evaporator 14.

It should be noted in one alternative embodiment, that the feed water in the bypass flow 24 is not required to enter into a portion of the economizer series 16, and may directly enter into the evaporator 14 at the high pressure steam drum 40 or between the evaporator 14 and the economizer series 16.

The dashed line 44 on FIG. 1 from the high pressure steam drum 40 to the level control valve 18, represents the communication between the evaporator 14 and the level control valve 18 which is used to regulate the volume of water in the high pressure steam drum 40.

The dashed line 44 extending between the steam flow meter 26 and the steam suppressor control valve 22 measures/meters the temperature and amount of steam exiting the superheater 12, and thereby regulates the amount and rate of the cool feed water flow 36 bypassing at least a portion of the economizer series 16 and entering into the high pressure steam drum 40 of the evaporator 14, thereby providing a desired steam flow exiting from the steam outlet 28, as recorded by the steam flow meter 26.

In some embodiments, exhaust from TEG 30 heats water in an economizer series 16 to near boiling, but to a temperature below a phase change of the water into steam. Normally the heated water would then exit the economizer series 16 and enter into the evaporator 14 for continued heating and to cause a phase change of the water into steam. The steam would then exit the evaporator 14 and enter into the superheater 12 for additional temperature increase. The heated steam exiting the superheater 12 will be used to drive a turbine generating electrical energy.

The bypass steam suppressor system 10 meters the steam flow and temperature exiting the superheater 12. If the steam flow exceeds the operational parameters of an HRSG receiving the steam flow, then the steam flow meter 26 will send an electrical signal to a steam suppressor control valve 22 which is located in the feed water conduit upstream from the evaporator 14. The steam suppression control valve 22 will then open, diverting feed water to bypass at least a portion of the economizer series 16. The level control valve 18 regulates the level of heated feed water mixed with cool feed water located in the high pressure steam drum 40 of the evaporator 14.

The pressure sensor 48 and the water level sensor 52 in the high pressure steam drum 40 will also communicate pressure data and the water level within the high pressure steam drum 40 to the processing logic circuit or processing unit 42. The processing logic circuit or processing unit 42 will regulate the opening and closing of the level control valve 18 and steam suppression control valve 22 as required to keep the HRSG operating within acceptable parameters.

The steam suppression control valve 22 is in fluid flow communication with bypass piping 34 which carries relatively cool feed water and extends from a point upstream relative to the economizer series 16, to a point between at least a portion of the economizer series 16 and the evaporator 14, and may alternatively be connected to the high pressure steam drum 40 of the evaporator 14.

When the steam flow meter 26 detects a steam flow exceeding a desired mass flow then the steam flow meter 26 sends a signal to open the steam suppressor control valve 22 for the cool feed water to directly enter into a portion of the economizer series 16. The cool feed water then bypasses at least a portion of the economizer series 16 and enters the feed water flow 36 entering the evaporator 14, and through mixing cools the temperature of the water in the evaporator 14. The introduction of cooler feed water prior to the evaporator 14 reduces the temperature of all of the water in the evaporator 14, which in turn reduces steam output from the evaporator 14 for transfer to the superheater 12. In order to prevent the evaporator 14 from receiving an excess volume of fluid, the evaporator 14 is in communication with the level control valve 18 through the processing unit 42. The processing unit 42 receives the water level in the high pressure steam drum 40 from the water level sensor 52. The processing unit 42 having logic control will signal for the incremental or partial closing, or the incremental or partial opening of the level control valve 18. If the sensed water level in the evaporator 14 is below a desired level then the processing unit 42 control logic will signal at least the partial opening of the level control valve 18.

When cool feed water is being permitted to bypass at least a portion of the economizer series 16, cooling the temperature of the water in the evaporator 14, the level control valve 18 will restrict flow of feed water into the economizer series 16, which in turn reduces the heated water exiting the economizer series 16 for entry into the evaporator 14. A combustion turbine upgrade for production of steam exceeding the operational parameters of a downstream HRSG may then be regulated through the combined manipulation of the cool water bypass flow 24 to the economizer series 16 or the evaporator 14, and the simultaneous reduction of water entering into the economizer series 16 through the level control valve 18, to avoid any excess amount of water or steam within the evaporator 14.

In at least one embodiment as shown in FIG. 1, a portion of the feed water flow 36 through the economizer series 16 is at least partially bypassed, and injected upstream of the hottest downstream economizer 38, just before the associated high pressure steam drum 40. Removing a portion of the feed water flow 36 through a portion of the economizer series 16 prevents the feed water from warming to the feed waters maximum potential temperature before entering the high pressure steam drum 40 and evaporator 14. This reduction in feed water temperature entering the high pressure steam drum 40 increases the approach temperature of the evaporators 14. A higher approach temperature reduces the steam production rates of the evaporator 14 due to cooler feed water entering the bypass steam suppressor system 10. Reducing the efficiency of the economizer series 16 reduces the steam production rate of the heat recovery steam generator without reducing the gas turbine load.

Bypassing the feed water flow 36 from the feed water inlet 20 to a location upstream of the hottest downstream economizer 38 also prevents the hottest downstream economizer 38 from steaming. The optimal bypass feed water injection location can be assessed using thermal modeling of the heat recovery steam generators. The exhaust gas temperature leaving the hottest downstream economizer 38 of the heat recovery steam generators should be lower than the steam saturation temperature at the system pressure to prevent economizer steaming. This procedure reduces risk that the economizer series 16 experience steaming that may potentially result in tube leaks.

A steam suppression control valve 22 in the bypass piping 34 regulates the feed water flow 36 being diverted away from the economizer series 16. The steam suppression control valve 22 may include a control logic circuit 42 having memory and a processing function in communication with the final steam production rate measured at the steam flow meter 26. Pressure measurement sensors 48 of the heat recovery steam generators may also be in communication with the control logic circuit 42. The bypass steam suppressor system 10 will activate if the combustion turbine exhaust energy causes the heat recovery steam generators to exceed its rated steaming capacity or specified pressure.

The rated steam flow rate and the maximum allowable working pressure (MAWP) can be programmed into the control logic of the processing unit 42 of the steam suppression control valve 22, whereupon the steam suppression control valve 22 may be modulated to keep the steam production rate, steam production capacity, pressure and/or MAWP below the limiting factors for the bypass steam suppressor system 10. Additional safety factors such as reducing the combustion turbine load may be added to the control logic for the processing unit 42 of the steam suppression control valve 22, if the HRSG begins to operate beyond the operating limits of the bypass steam suppressor system 10.

Installing the bypass steam suppressor system 10 may also require installation of bypass piping 34 to accommodate the economizer bypass flow 24 loop and the steam suppression control valve 22.

In at least one embodiment, the steam suppression control valve 22 is in communication with an integral or independent processing unit 42. Processing unit 42 includes memory and control software to receive steam flow readings/data such as steam flow temperature or pressure from the steam flow meter 26; the high pressure steam drum 40 feed water level, temperature readings/data, and/or pressure readings/ data; the temperature readings from the evaporator 14; the steam flow rate from the evaporator 14; the feed water flow level and feed water temperature readings/data from the economizer series 16; and the inlet feed water flow and temperature readings/data from the feed water inlet 20.

The processing unit 42 may be in communication with the feed water level control valve 18, the steam suppression control valve 22, the sensors of the economizer series 16, evaporator 14, the superheater 12, and the steam flow meter 26.

From the data communicated from the sensors of the steam flow meter 26, superheater 12, high pressure steam drum 40, and the evaporator 14, the processing unit 42 may activate the level control valve 18 to increase or decrease the rate of introduction of feed water into the economizer series 16, evaporator 14 and superheater 12.

From the data communicated from the sensors of the steam flow meter 26, superheater 12, high pressure steam drum 40, evaporator 14, and the economizer series 16, the processing unit 42 may simultaneously or independently regulate the incremental opening and closing of the level control valve 18 and steam suppression control valve 22. The level control valve 18 adjusts the rate of feed water inflow 36 from the feed water inlet 20 into the economizer series 16, the high pressure steam drum 40, and the steam from the evaporator 14 and the superheater 12.

The steam suppression control valve 22 adjusts the rate or amount of feed water flow 36 functioning as bypass flow 24, passing through the bypass piping 34. The feed water flow 36 from the steam suppression control valve 22 enters the hottest downstream economizer 38. Processing unit 42 thereby maximizes performance for the bypass steam suppressor system 10 and simultaneously functions as one system safety device where the level control valve 18 or steam suppression control valve 22 may be independently and/or jointly be manipulated, so that pressure and temperature limitations remain within acceptable operational parameters.

The communication pathways 44 are shown in FIG. 1 between the components of the bypass steam suppressor system 10. The water level in the high pressure steam drum 40 is represented by reference numeral 46.

Additional hardware such as piping supports, hangers, and space available to accommodate a piping loop should also be considered before installing the bypass steam suppressor system 10 to an HRSG.

In at least one embodiment, thermal modeling simulations performed on the bypass steam suppression system 10 have shown a reduction of up to 5% of the final high pressure steam flow rate and the pressure in the high pressure steam drum 40 in a triple pressure (with Reheat) HRSG behind a GE Frame 7™ combustion turbine (or equivalent). These results were obtained from simulations where the combustion turbine operates at sustained baseload. However, these results and the steam suppression bypass system 10 effectiveness vary on a case-by-case basis depending on the heat recovery steam generator design and combustion turbine model.

The bypass steam suppressor system 10 enables heat recovery steam generators that operate at design limits to control both steam generation and pressure, while allowing the combustion turbine to operate at the intended base load.

The economizers series 16 improves the overall efficiency of a boiler by increasing the feed water temperature before it reaches the evaporator system. Once the feed water reaches an evaporator 14, it turns into steam in the high pressure steam drum 40. The economizer series 16 aims to warm up the feed water enough with a margin to saturation, so that a large amount of energy is not needed to convert the feed water into steam. The difference between the saturation temperature at the high pressure steam drum 40 (or attached evaporator) and the temperature of the feed water exiting the economizer series 16 is called the approach temperature. A smaller approach temperature results in lower energy required to turn the feed water into steam. Increasing the approach temperature can result in reduced steam production from the evaporator 14 as more energy would be required to generate the steam from the feed water. The approach temperature should also not be too small, resulting in feed water turning into steam within the economizer series 16 and resulting in tube failures.

In at least one first alternative embodiment a method of suppressing steam production in a heat recovery steam generator includes diverting a flow of feed water upstream from an economizer series, controlling the volume of the diverted flow of feed water and bypassing a portion of the economizer series from receiving the controlled volume of diverted flow of feed water, returning the controlled volume of diverted flow of feed water to a downstream portion of the economizer series, heating the controlled volume of diverted flow of feed water in the downstream portion of the economizer series to reduce an approach temperature, transferring the heated controlled volume of diverted flow of feed water to a high pressure steam drum in fluid flow communication with an evaporator, mixing the heated controlled volume of diverted flow of feed water with heated steam drum water reducing the temperature of mixed water in the high pressure steam drum, passing the mixed water from the high pressure steam drum to the evaporator producing steam, reducing the rate of steam production for the mixed water in the evaporator, reducing the steam pressure in the evaporator, and decreasing the steam flow exiting the evaporator, transferring the steam flow exiting the evaporator to a superheater, and metering the steam flow exiting the superheater.

In a second alternative embodiment according to the first embodiment, the method includes having the diverted flow of feed water upstream from an economizer series being in fluid flow communication with a steam suppression control valve, the steam suppression control valve being located upstream from the downstream portion of the economizer series.

In a third alternative embodiment according to the second embodiment, the method includes the step of regulating the volume of heated steam drum water within the high pressure steam drum at a level control valve.

In a fourth alternative embodiment according to the third embodiment, the method includes diverting a flow of feed water upstream from an economizer series to enter bypass piping, the level control valve being located downstream from the bypass piping and upstream from the economizer series.

In a fifth alternative embodiment according to the fourth embodiment, the method includes the step of incrementally opening or closing the level control valve and regulating the volume of feed water entering the economizer series, the high pressure steam drum and the evaporator, by communication of a water level from a water level sensor to the level control valve, the water level sensor being in the high pressure steam drum.

In a sixth alternative embodiment according to the fifth embodiment, the method includes the step of incrementally opening or closing the steam suppression control valve and regulating the controlled volume of diverted flow of feed water entering the downstream portion of the economizer series by communication of a steam flow rate from a steam flow sensor or a pressure value from a pressure sensor, to the steam suppression control valve, the steam flow sensor and the pressure sensor being located in the high pressure steam drum.

In a seventh alternative embodiment according to the sixth embodiment, the method includes the step of communicating a water temperature from a water temperature sensor and the pressure value from the pressure sensor, and the water level from the water level sensor to a control logic, the control logic being in communication with the steam suppression control valve, and incrementally opening or closing the steam suppression control valve adjusting the temperature of the mixed water in the high pressure steam drum or steam pressure in the high pressure steam drum.

In an eighth alternative embodiment according to the seventh embodiment, the method including the step of measuring the temperature of the steam and the amount of the steam exiting the superheater or a steam outlet by a steam flow meter.

In a ninth alternative embodiment according to the eighth embodiment, the method includes the step of communicating the temperature of the steam and the amount of the steam exiting the superheater or a steam outlet to the control logic, the control logic incrementally opening or closing the steam suppression control valve adjusting the steam flow exiting the superheater or the steam outlet.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

We claim:

1. A method of suppressing steam production in heat recovery steam generator comprising:

diverting a flow of feed water upstream from an economizer series;

controlling the volume of the diverted flow of feed water and bypassing a portion of the economizer series from receiving the controlled volume of diverted flow of feed water;

returning the controlled volume of diverted flow of feed water to a downstream portion of the economizer series;

heating the controlled volume of diverted flow of feed water in said downstream portion of the economizer series to reduce an approach temperature;

transferring the heated controlled volume of diverted flow of feed water to a high pressure steam drum in fluid flow communication with an evaporator;

mixing the heated controlled volume of diverted flow of feed water with heated steam drum water reducing the temperature of mixed water in the high pressure steam drum;

passing the mixed water from the high pressure steam drum to the evaporator producing steam;

reducing the rate of steam production for the mixed water in the evaporator, reducing the steam pressure in the evaporator, and decreasing the steam flow exiting the evaporator;

transferring the steam flow exiting the evaporator to a superheater; and metering the steam flow exiting the superheater.

2. The method according to claim 1, wherein the diverted flow of feed water upstream from an economizer series is in fluid flow communication with a steam suppression control valve, the steam suppression control valve being located upstream from said downstream portion of the economizer series.

3. The method according to claim 2, further comprising the step of regulating the volume of heated steam drum water within said high pressure steam drum by manipulating a level control valve.

4. The method according to claim 3, wherein said diverting a flow of feed water upstream from an economizer series enters bypass piping, said level control valve being located downstream from said bypass piping and upstream from said economizer series.

5. The method according to claim 4, further comprising the step of incrementally opening or closing said level control valve and regulating said volume of feed water entering said economizer series, said high pressure steam drum and said evaporator, by communication of a water level from a water level sensor to said level control valve, said water level sensor being in said high pressure steam drum.

6. The method according to claim 5, further comprising the step of incrementally opening or closing said steam suppression control valve and regulating said controlled volume of diverted flow of feed water entering said downstream portion of the economizer series by communication of a steam flow rate from a steam flow sensor or a pressure value from a pressure sensor, to said steam suppression control valve, said steam flow sensor and said pressure sensor being located in said high pressure steam drum.

7. The method according to claim 6, further comprising the step of communicating a water temperature from a water temperature sensor and said pressure value from said pressure sensor, and said water level from said water level sensor to a control logic, said control logic being in communication with said steam suppression control valve and incrementally opening or closing said steam suppression control valve adjusting the temperature of said mixed water in the high pressure steam drum or a steam pressure in the high pressure steam drum.

8. The method according to claim 7, further comprising the step of measuring the temperature of said steam and the amount of said steam exiting said superheater or a steam outlet by a steam flow meter.

9. The method according to claim 8, further comprising the step of communicating the temperature of said steam and the amount of said steam exiting said superheater or a steam outlet to said control logic, said control logic incrementally opening or closing said steam suppression control valve adjusting said steam flow exiting said superheater or said steam outlet.

* * * * *